US011374354B2

(12) United States Patent
Semik

(10) Patent No.: US 11,374,354 B2
(45) Date of Patent: Jun. 28, 2022

(54) LINEAR ELECTRICAL CONNECTOR WITH HELICALLY DISTRIBUTED TERMINATIONS

(71) Applicant: SAFRAN ELECTRICAL COMPONENTS USA, INC., Santa Rosa, CA (US)

(72) Inventor: Jared Semik, Santa Rosa, CA (US)

(73) Assignee: Safran Electrical Components USA, Inc., Santa Rosa, CA (US)

( * ) Notice: Subject to any disclaimer, the term of this patent is extended or adjusted under 35 U.S.C. 154(b) by 0 days.

(21) Appl. No.: 16/783,927

(22) Filed: Feb. 6, 2020

(65) Prior Publication Data

US 2021/0249813 A1 Aug. 12, 2021

(51) Int. Cl.

| | |
|---|---|
| ***H01R 13/623*** | (2006.01) |
| ***H01R 13/05*** | (2006.01) |
| ***H01R 13/26*** | (2006.01) |
| ***H01R 13/642*** | (2006.01) |

(52) U.S. Cl.

CPC ..... *H01R 13/623* (2013.01); *H01R 13/052* (2013.01); *H01R 13/26* (2013.01); *H01R 13/642* (2013.01)

(58) Field of Classification Search

CPC .... H01R 13/623; H01R 13/052; H01R 13/26; H01R 13/642; H01R 24/38

See application file for complete search history.

(56) References Cited

U.S. PATENT DOCUMENTS

| | | | | | |
|---|---|---|---|---|---|
| 2,892,990 | A * | 6/1959 | Werndl | H01R 13/193 | 439/265 |
| 3,193,636 | A * | 7/1965 | Daniels | H01R 39/64 | 200/51.12 |
| 3,333,232 | A * | 7/1967 | Patton, Jr. | H01R 24/38 | 439/680 |
| 3,429,041 | A * | 2/1969 | Patton, Jr. | H01R 43/24 | 29/883 |
| 3,497,866 | A * | 2/1970 | Patton, Jr. | H01R 24/38 | 439/680 |
| 3,831,133 | A * | 8/1974 | Grundfest | H01R 23/26 | 439/680 |
| 4,421,371 | A * | 12/1983 | Clark | H01R 13/631 | 439/249 |
| 5,409,403 | A * | 4/1995 | Falossi | H01R 24/38 | 439/21 |
| 9,281,638 | B2 * | 3/2016 | McBroom | H01R 24/38 | |

(Continued)

FOREIGN PATENT DOCUMENTS

WO 2021158870 A1 8/2021

OTHER PUBLICATIONS

International Patent Application No. PCT/US2021/016747, International Search Report and Written Opinion, dated Apr. 26, 2021.

*Primary Examiner* — Travis S Chambers
(74) *Attorney, Agent, or Firm* — Kilpatrick Townsend & Stockton LLP

(57) ABSTRACT

An electrical pin connector including a receptacle and a plug configured for matable connection, the plug and the receptacle each including conical backshells with a surface disposed about a central axis and a plurality of pin receptacles helically disposed in parallel curves around the central axis on the conical backshell surface for terminating conductors.

12 Claims, 13 Drawing Sheets

(56) References Cited

U.S. PATENT DOCUMENTS

| | | | | |
|---|---|---|---|---|
| 9,496,638 | B1 | 11/2016 | Su et al. | |
| 10,923,852 | B2 * | 2/2021 | Huang | H04M 1/0249 |
| 2016/0043505 | A1 * | 2/2016 | Wu | H01R 35/02 439/217 |
| 2016/0365678 | A1 | 12/2016 | Thackston | |
| 2017/0179631 | A1 | 6/2017 | Feldchtein | |
| 2021/0050688 | A1 * | 2/2021 | Lee | H01R 13/52 |

* cited by examiner 200
202
202b
250
254
250
202a
202c
206b
250
206
206a
254
250
202d
204b
252
256b
238b
256a
204
252
204a
238a
238d
208b
238
214
252
238c
250
212
208
232b
208a
232f
232a
232d
234b
262
232
250
232c
226
228
234a
234d
236b
234
236a
264
234c
236d
224
236
264
210b
236c
210

210a

LINEAR ELECTRICAL CONNECTOR WITH HELICALLY DISTRIBUTED TERMINATIONS

CROSS REFERENCES TO RELATED APPLICATIONS

Not applicable. The present application is an original and first filed United States Utility Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

SEQUENCE LISTING

Not applicable.

BACKGROUND OF THE INVENTION

Field of the Invention

The present invention relates most generally to electrical conduits, cables, and connectors, and more particularly to a multi-contact electrical connector assembly for interconnect wiring systems, and still more particularly to an electrical connector having plug and receptacle contact terminations configured with terminating pins distributed helically over conical surfaces in both plug and receptacle elements. The inventive connector is adapted for use in highly confined spaces, such as in aircraft electrical connector panels, in which large numbers of electrical cables converge for organization and sorting through harnesses and other cable organization apparatus and for connection to navigation, communication, and electronics systems.

Background Discussion

Vehicle and aircraft systems are frequently located remotely from power and signal sources, and conductors and cables frequently pass through structural boundaries, bulkheads, panels, chassis, and walls separating vehicle/aircraft primary structures—wings from fuselage, cargo area from cabin, cabin from tail assembly, power plants from wing or cockpit, fuselage from landing gear, and so forth. Until wireless local signal transmission is perfectly reliable and perfectly secure with high rates of data transfer, cables will be employed for these purposes. Wiring for cabin systems, environmental controls and lighting, avionics, flight controls, auxiliary power units and engine-driven alternators, as well as backup power supplies, AC inverters, control systems, servo motors, electric-over-hydraulic motors and actuators, lights, and so forth, are typically bundled and organized in harness assemblies and infrequently contained in conduits (because of weight limitations). The assemblies and their conductors take up considerable space, especially at bends, junctions, and barrier walls. Space constraints and the need to protect structural integrity and to secure interior air pressures and climate put a premium on minimizing barrier penetrations, thus the space dedicated to electrical connectors and harness assemblies.

In a worst case scenario, routing of cable harnesses within aircraft is sometimes not even possible because a terminated connector is too large in diameter to pass through an opening. The diameter of standard multi-contact connectors is a function of the number and size of the contacts. The problem of routing and "fit" thus usually occurs when a connector has a large number of contacts for a bundle of heavy gauge conductors, which require larger contacts. Therefore, there is a continuing motivation to reduce the space and weight consumed by multi-contact electrical connectors for electrical components, particularly including mating rack and panel systems in aircraft. These motivations—both as to weight and space—are of paramount importance in the development of electrically powered aircraft.

Current solutions to weight and space constraints for connectors include various area-reducing pin geometries and manufacturing techniques that increase pin distribution density in an axially connected electrical plug. However, there are inherent limitations in wire distribution density. Most notably, there is a limitation the number of wire termination pins that can occupy a given circular cross section in a plug before electrical contact occurs between the conductors. A minimum separation is necessary to ensure proper insulation. The paramount issue in the design considerations is how to create a wire termination (pin) with a bare minimum diameter.

BRIEF SUMMARY OF THE INVENTION

Seen in its most essential aspect, the present invention is a pin electrical connector configured to distribute terminated contact diameters helically/radially along a central axis. The connector solves the issue of pin overcrowding (density) and the limitation of pins per connector area found in traditional circular cross-section connectors. Thereby it also solves the problem of increasing connector cross-sectional area corresponding to an increase in pin quantity.

Each of the male and female connectors of the inventive electrical plug and receptacle distribute electrical pin terminations helically, in parallel curved rows, along the surface of a backshell cylinder instead of the face of a circular or square face. (As used herein, "parallel curves" means curves spaced apart by a fixed normal and constant distance of offset.) By redistributing the pins along a conical surface at the connector end, regardless of pin diameter, an increased number of pins can be inserted into the connector with no penalty incurred in having to increase overall connector cross-sectional diameter. Additionally, conductors are oriented along the axis of the connector and are molded into the connector itself, thereby eliminating the need for internal contacts. This reduces the effective diameter of the connector and thereby increases the potential density of contacts.

More specifically, the design and method of distribution of contacts distributes the required pin diameters along three dimensions (r, θ, z, using cylindrical coordinate nomenclature) rather than two (r, θ). Whereas there is a limited area of conductor density in traditional (r, θ) distributed contacts, conductor density can be substantially increased by also arraying contacts along the z axis. The present invention achieves just such a characteristic.

This invention also maximizes the cross sectional density of wire conductors by integrating the insulation into connectors and transferring the distribution of wire connections along a helical array about a cylinder. Presently, the limiting factor in reducing wire connector diameter is pin and wire diameter: $Ø_{pin}>Ø_{wire}$. However, both pin and wire diameter limit the distribution density (wires per Ø or $A_{cross\ section}$). Two strategies address this limitation: (1) removal of wire insulation through the connector to reduce wire-to-center conductors distributed in a manner that maximizes insulative separation of the wires and increases wire throughput with respect to axial cross-section of the connector; and (2) helical distribution of wire termination pins about a conical geometry, which improves wire termination pin distribution over the typical circular cross-section by adding an additional distribution dimension along the center axis. This increases the potential density of pins relative to the diameter dimension (Ø) without the need for a major modification of termination pins (although an improved pin design may comprise part of design optimization).

Thus, and as will be appreciated when viewing the appended drawings and the detailed description below, the configuration of the electrical connector is such that it can accommodate increasingly large numbers of conductors without having to expand the cross-sectional area of the connector (male plug and female receptacle) housings. As cables or conductors are added, they are terminated at termination points on cylindrical surfaces in each of the male and female connector elements.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
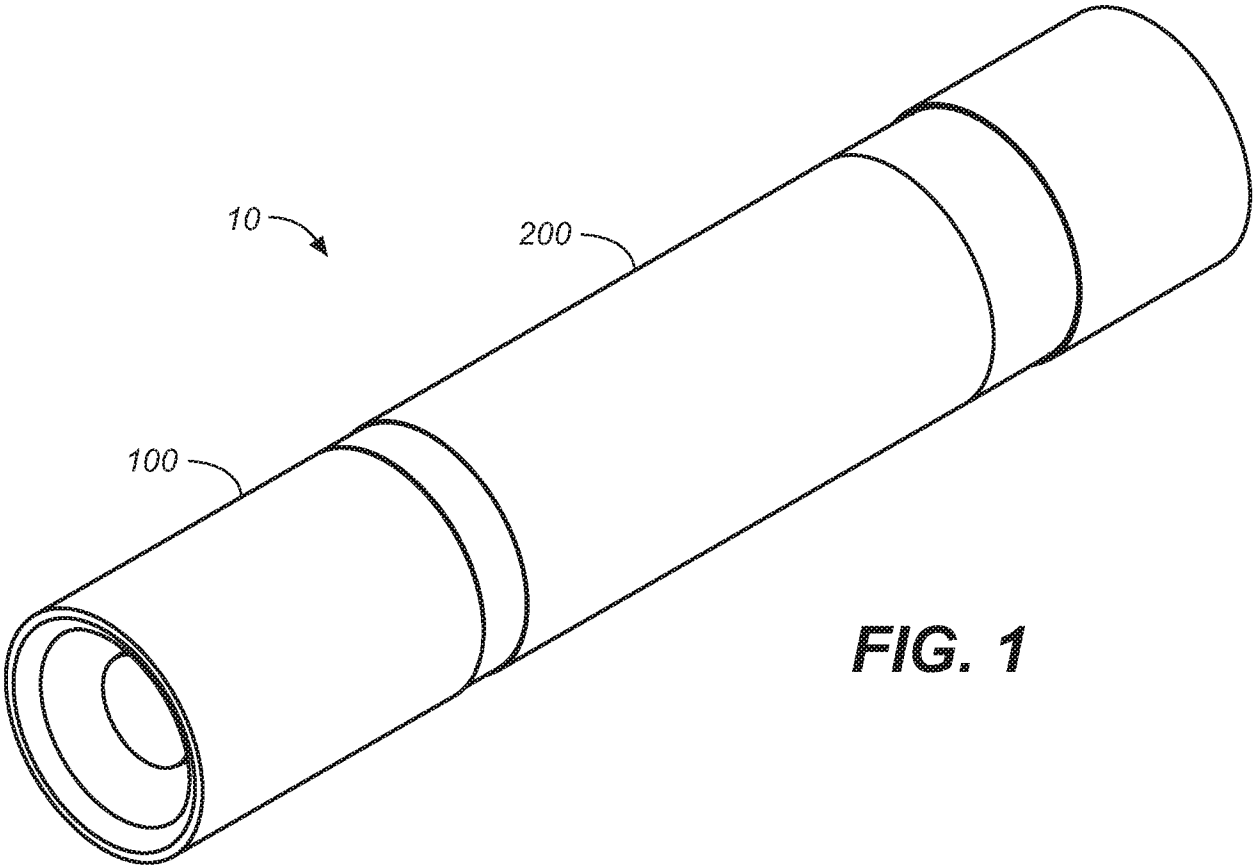
FIG. 1 is an upper perspective view of the assembled linear connector with the plug and receptacle mechanically and electrically coupled.
Figure 2:
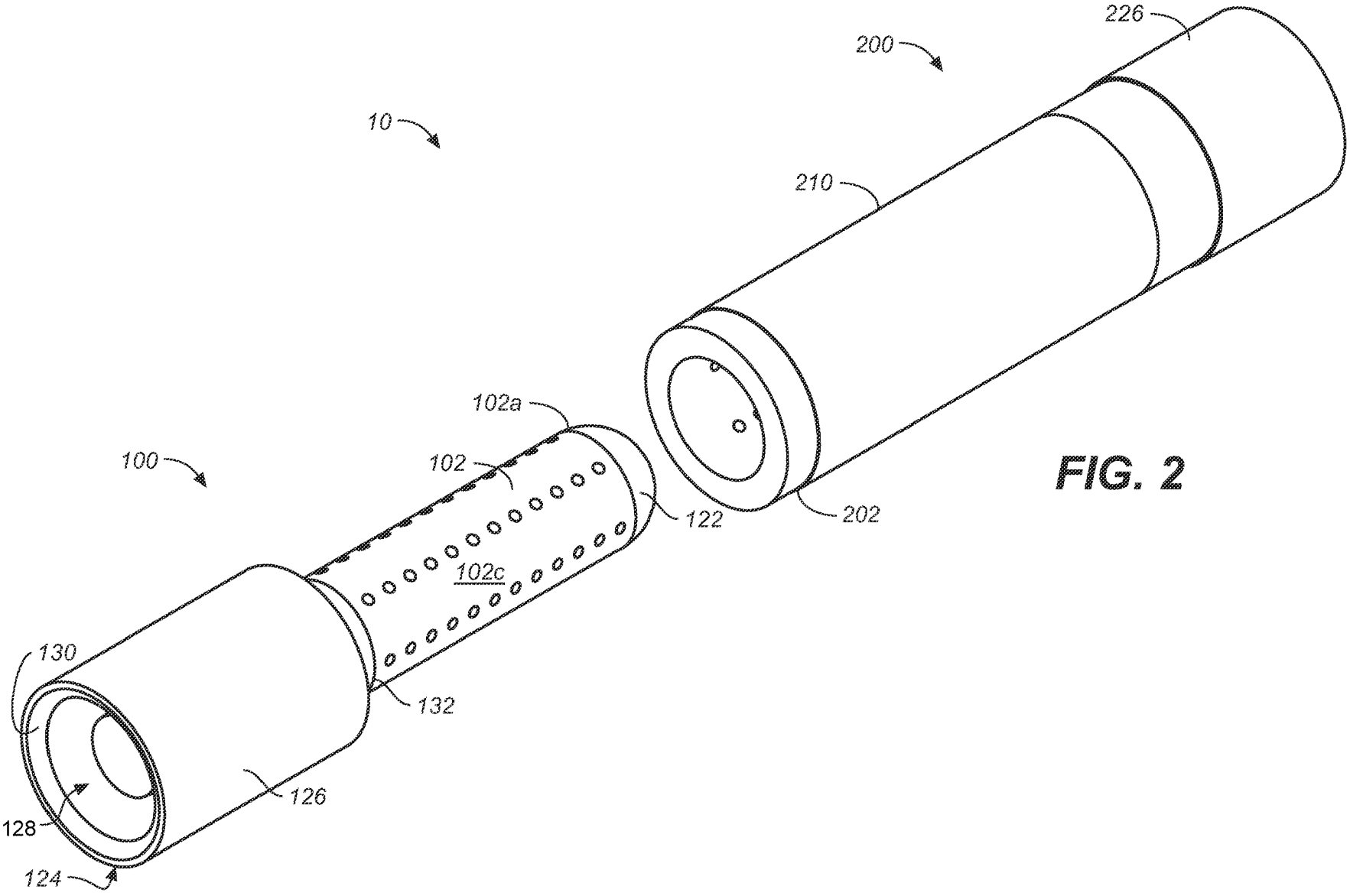
FIG. 2 is the same view with the plug removed from the receptacle.

Reference will now be made in detail to specific embodiments or features, examples of which are illustrated in the accompanying drawings. Generally, corresponding reference numbers will be used throughout the drawings to refer to the same or corresponding parts. Also, wherever possible, the same reference numbers will be used throughout the drawings to refer to the same or the like parts.

Referring first to FIGS. 1A through 14, wherein like reference numerals refer to like components in the various views, there is illustrated therein an embodiment of a new and improved electrical connector, generally denominated 10 herein. In an embodiment, the device includes first and second connector matable connectors halves 100, 200, which are a complementary pair comprising a male connector half (a plug) and a female connector half (a receptacle), respectively. As will be immediately appreciated, in an embodiment, the male connector half 100 and the female connector half 200 may be cylindrical in overall exterior geometry (thus, circular in cross-section as viewed on end), though the exterior cross-sectional geometry is non-essential, and therefore non-limiting. Interior geometry, however, is necessarily cylindrical to achieve the space-saving objectives of the present invention.

The male connector half and female connector half are each generally hollow tubular shells that can accommodate wires or cables. As such, male connector half 100 first includes an inboard male shell 102, and first through fourth male concentric sleeves 104, 106, 108, 110, which are successively smaller in diameter and insert axially into an open end of the immediately larger diameter concentric sleeve having clearances with close tolerances. The largest male concentric sleeve 104, in turn, inserts into the male shell 102.

At the outboard end 124 of the male connector half is a wire keep 126 having an open outer end 128 with a beveled inner rim 130. The male shell 102 extends inwardly from the inboard end 132 of the wire keep 126.

Thus, as noted, each of the concentric sleeves includes an inboard end and an outboard end, 104*a*, 106*a*, 108*a*, 110*a*; and 104*b*, 106*b*, 108*b*, and 110*b*, respectively. In assembly the concentric sleeves each insert into the next larger diameter sleeve with tight tolerances, such that the outer cylindrical surface of each sleeve slidably approximates and engages the inner surface of the next larger concentric sleeve. When inserted and assembled, in a nested configuration the respective inboard ends 104*a*, 106*a*, 108*a*, 110*a*, of the concentric sleeves extend to and align with the inboard terminal end 102*a* of the cylindrical portion of the male shell 102, where the shell converges uniformly and inwardly into a hemispherical inboard male end 122*c*. When thus assembled, the outboard ends of the concentric sleeves are in coplanar alignment with one another and with the outboard terminal end 102*b* of the male shell 102 (see FIG. 6B).

The male connector half next includes a plurality of nested male backshells, 132, 134, 136, 138, 140, being the same in number as the concentric sleeves. Each of the male backshells includes an inboard end and an outboard end, 132*a*, 134*a*, 136*a*, 138*a*, 140*a*; and 132*b*, 134*b*, 136*b*, 138*b*, and 140*b*, respectively; a cylindrical portion 132*c*, 134*c*, 136*c*, 138*c*, and 140*c*; and a conical portion 132*d*, 134*d*, 136*d*, 138*d*, and 140*d*. The outermost backshell 132, and only the outermost backshell, is not inserted into any other backshell, includes a closed end 132*e*, and provides a surface having a plurality of helically (spirally) curved, offset (parallel) rows of pin receptacles (apertures) in which conductors are inserted and terminated.

In assembly the conical backshells each insert into the next larger diameter backshell with tight tolerances, such that the outer surfaces of the conical portion and cylindrical portion of each male backshell slidably approximates and engages the inner surface of the next larger backshell. When assembled and in a nested configuration, the inner ends of the male backshells are in planar alignment with one another and the outboard ends also align with one another (again, see FIG. 6B).

Note will be taken that the male shell 102 as well as each concentric sleeve between the smallest concentric sleeve 110 and the male shell 102 includes several axially oriented parallel rows 150 of pin apertures 152. In an embodiment, and as shown in the views, each concentric sleeve includes 6 rows of 12 apertures. In assembly, the helically curved rows of the nested concentric sleeves are stacked and aligned, such that the aligned apertures create continuous through holes or pin receptacles through the male shell 102 down to the innermost concentric sleeve 110.

Inserted into the passages (pin receptacles) and extending from the surface 102*d* of the male shell 102 are conductive pins 154 configured to secure the concentric sleeves in their nested configuration and to provide a conductive path from the male shell surface to a conductive filament 155 disposed in a channel on one of the interior concentric sleeves. The pins may include a depressible contact portion for mating with the complementary female connector half.

To that end, it will further be noted that each concentric sleeve includes a plurality of filament channels 156 disposed around the surface of the concentric sleeve, each of the channels including a transverse portion 156*a* extending from a pin receptacle to a longitudinal portion 156*b*, which extends to the outboard end. While the structural features are best seen in connection with the concentric sleeves of the female connector half 200, and shown in detail in FIGS. 8A-10B, in relation to the male connector, each row of pin receptacles in the largest diameter concentric sleeve 104 includes four filament channels. Taking the inboard pin receptacle (that nearest the inboard end 104*a*) as the first ($1^{st}$) and the outboard pin receptacle as the last ($12^{th}$ in the embodiment illustrated), concentric sleeve 104 includes filament channels extending from the $1^{st}$, $4^{st}$, $7^{th}$, and $10^{th}$ pin receptacles on each row. It will be noted that the transverse portion is shortened for each successive filament channel, thus separating the longitudinal portions of the filament channels with non-conductive sleeve material.

Concentric sleeve 106 also includes four filament channels for each parallel row of pin receptacles, one each extending from the $2^{nd}$, $5^{th}$, $8^{th}$, and $11^{th}$ pin receptacles, respectively.

Concentric sleeve 108 includes three filament channels for each parallel row of pin receptacles, one each extending from the $3^{rd}$, $6^{th}$, and $9^{th}$ pin receptacles. However, as will be appreciated by those with skill, this is merely an exemplary pattern distribution; hole and conductive filament channel distributions can take multiple possible configurations, and while they needn't be regular sequences, device logic and manufacturing are greatly enhanced using regular sequences.

Finally, as to the set of concentric sleeves, concentric sleeve 110 includes a single filament channel for each row of pin receptacles.

Similar to the concentric sleeves, each of the conical portions, 132*d*, 134*d*, 136*d*, 138*d*, 140*d*, of the nested backshells, 132, 134, 136, 138, and 140 includes a plurality of spaced apart rows 160 of pin receptacles 162, identical in number with the number of apertures in the concentric sleeves. The rows, by contrast, are not oriented axially or longitudinally, but are angled slightly counterclockwise when viewed on end from the outboard end, which entails looking from the tapered end up the continuous conical side toward the cylindrical portion. Each row terminates at the junction of the conical with the cylindrical portion (i.e., where the conical portion abruptly transitions to the cylindrical portion).

Further, all inserted backshells include filament channels 164 which, like those disposed on the concentric sleeves, include a transverse portion and a longitudinal portion, the latter angled substantially parallel to the neighboring rows of apertures. The filament channels angle longitudinally to continue in parallel rows over the cylindrical portion where they terminate at the inboard end of the backshell. Again, as with the concentric sleeves, the filament channels extend from regularly spaced pin receptacles on each of the rows of pin receptacles on the conical portion: the largest inserted backshell, 134, includes filament channels in each row 160 of pin receptacles 162 extending from the $1^{st}$, $4^{th}$, $7^{th}$ and $10^{th}$ pin receptacles (counting from the outboard end of the rows); the next largest inserted backshell, 136, includes filament channels in each row of pin receptacles extending from the $2^{st}$, $5^{th}$, $8^{th}$, and $11^{th}$ pin receptacles; the next largest inserted backshell 138 includes filament channels in each row of pin receptacles extending from the $3^{rd}$, $6^{th}$, and $9^{th}$ pin receptacles; and the smallest inserted backshell 140 includes filament channels in each row of pin receptacles on only the $12^{th}$ pin receptacle in each row.

As earlier noted, when assembled and in a nested configuration, the inner ends of the male backshells are in planar alignment with one another and the outboard ends also align with one another. The pin receptacles of each "layer" of the backshells are also in alignment with one another and extend through and from the outermost backshell 132 down to the innermost backshell 140.

The structural aspects of the filament channels on the male plug elements (i.e., the backshells and the concentric sleeves) are set out in more detail in connection with the description of the female connector element 200, below. For the moment, and summarily stated, each channel is an unbroken elongate recess cut or formed in the surface of the concentric sleeve and continuing on an adjoining backshell. It originates and issues from a concentric sleeve pin aperture extending from one of the concentric sleeves and terminates at a receptacle hole in the adjoining male backshell. A conductive filament is connected to a pin in the concentric sleeve pin aperture and runs the length of the channel from the pin aperture, first transversely along the transverse portion of the channel on the concentric sleeve, then longitudinally (axially) in and along the channel, over the adjoining edges of the correspondingly sized concentric sleeve and backshell, and continuing on the backshell cylindrical and conical portions until it turns at the transverse portion on the backshell and terminates at a pin receptacle on the backshell.

Figure 3A:
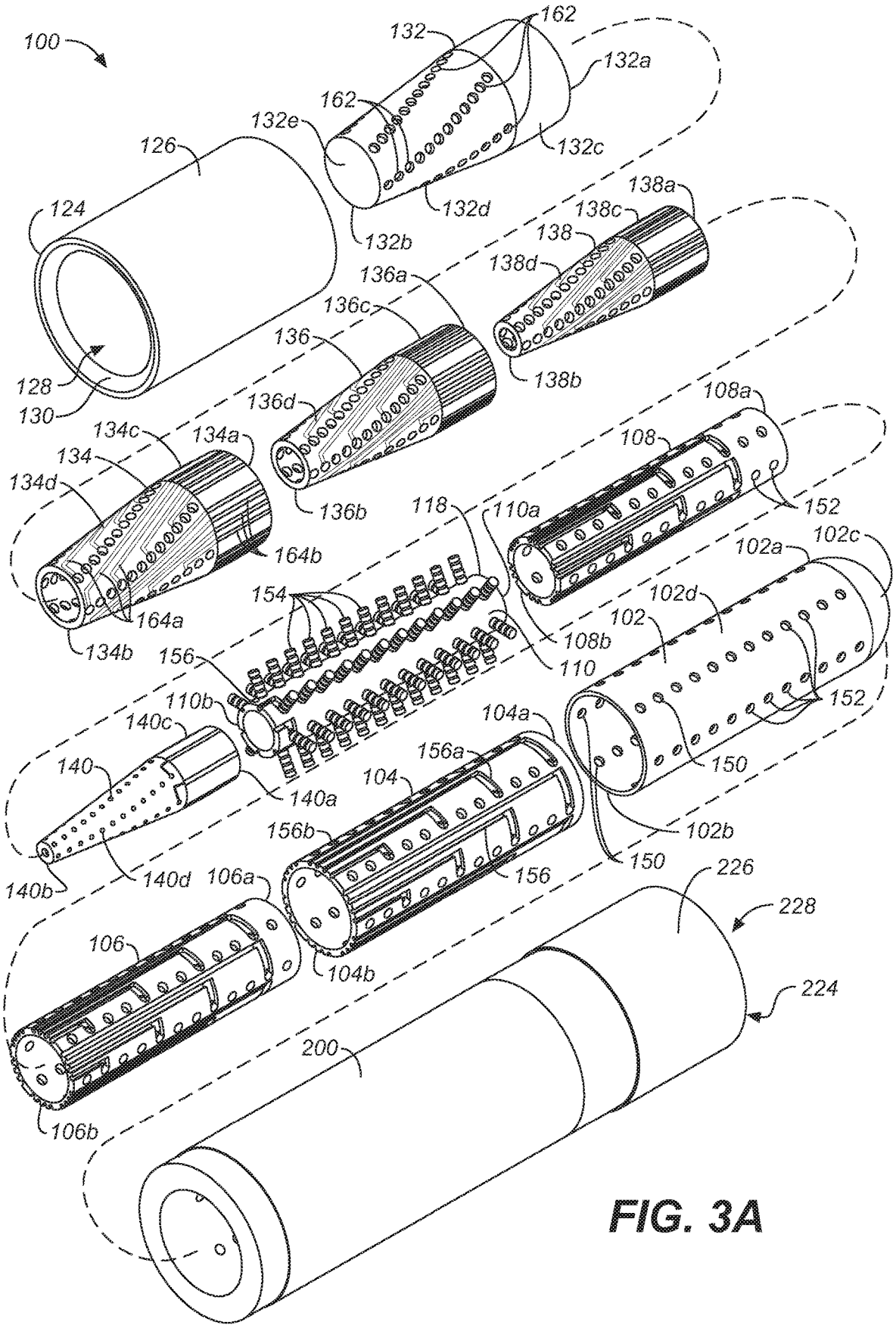
FIG. 3A is an exploded upper perspective view of the plug element (male connector), showing the receptacle element (female connector) assembled.
Figure 3B:
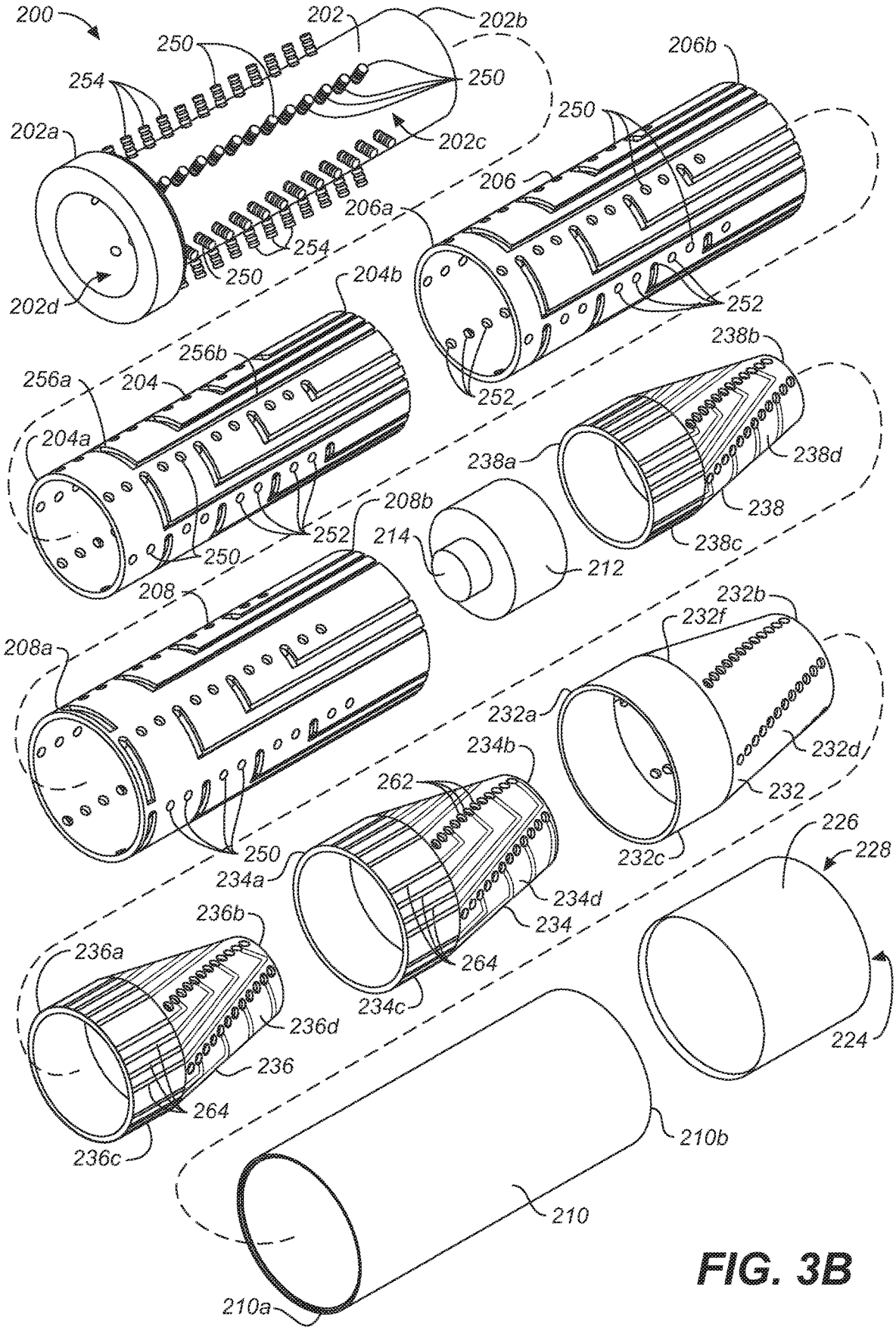
FIG. 3B is an exploded upper perspective view of the female connector of the non-helical connector of the present invention, showing male connector absent in this view.
Figure 4A:
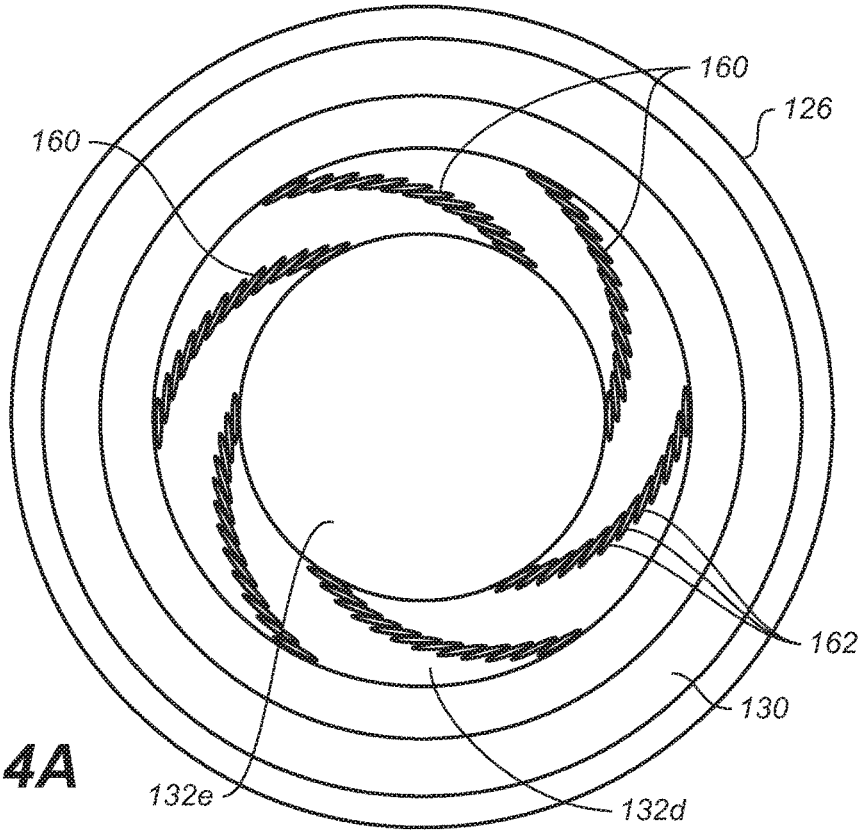
FIG. 4A is an outboard end view in elevation of the male connector.
Figure 4B:
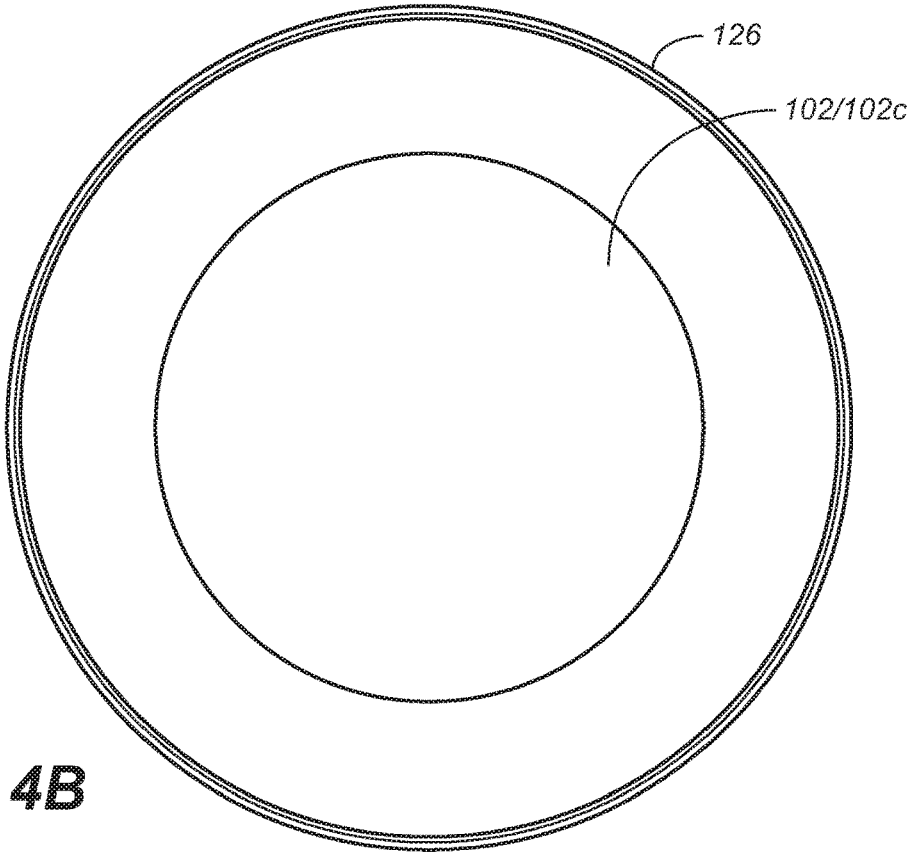
FIG. 4B is an inboard end view thereof, in elevation.
Figure 5A:
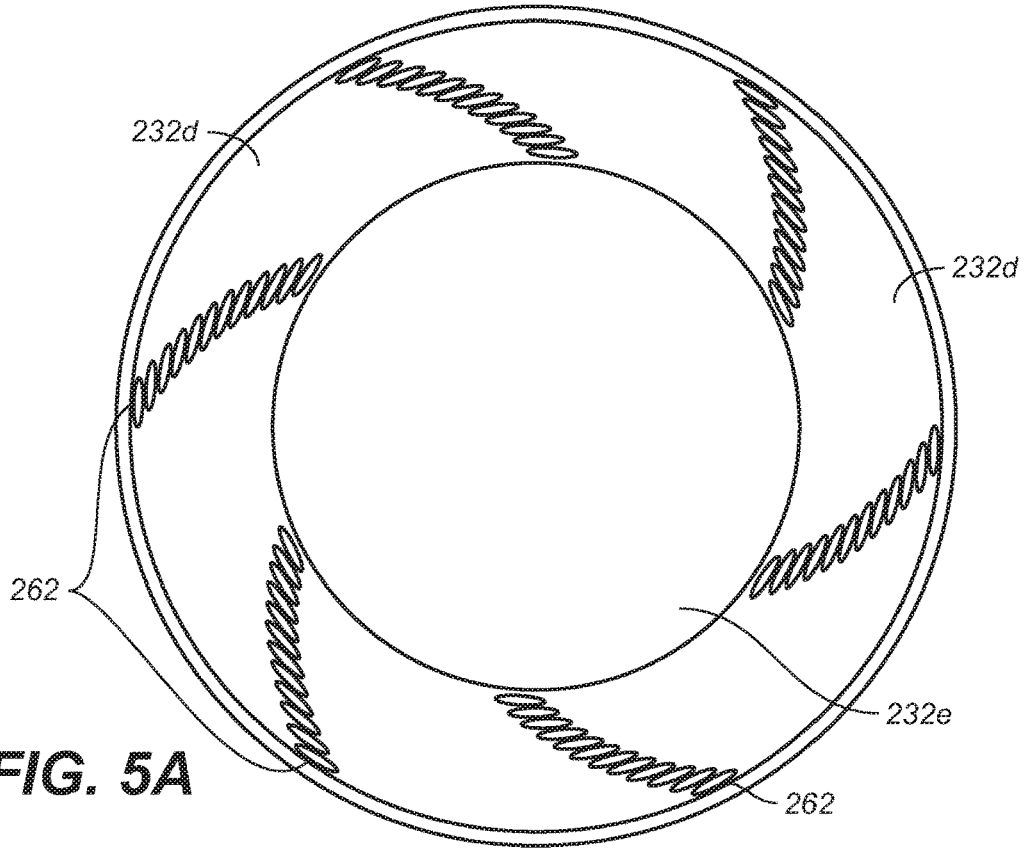
FIG. 5A is an outboard end view in elevation of the female connector.
Figure 5B:
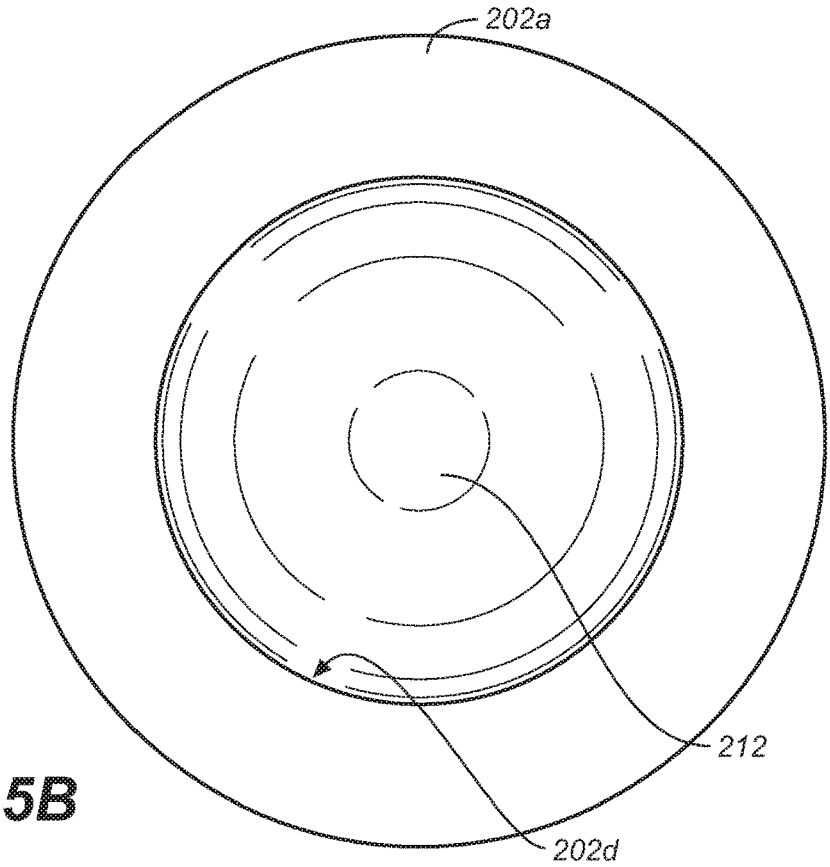
FIG. 5B is the inboard end view thereof.
Figure 6A:
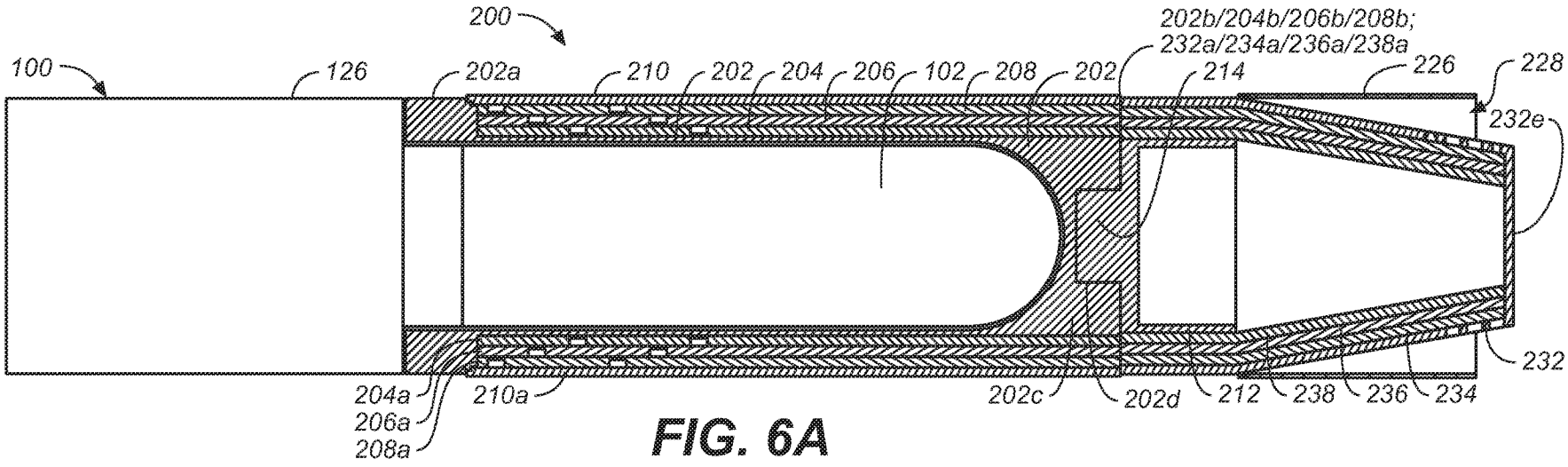
FIG. 6A is a cross-sectional side view in elevation of the male and female connectors coupled, this view showing details of the nested female connector sleeves and backshell rings.
Figure 6B:
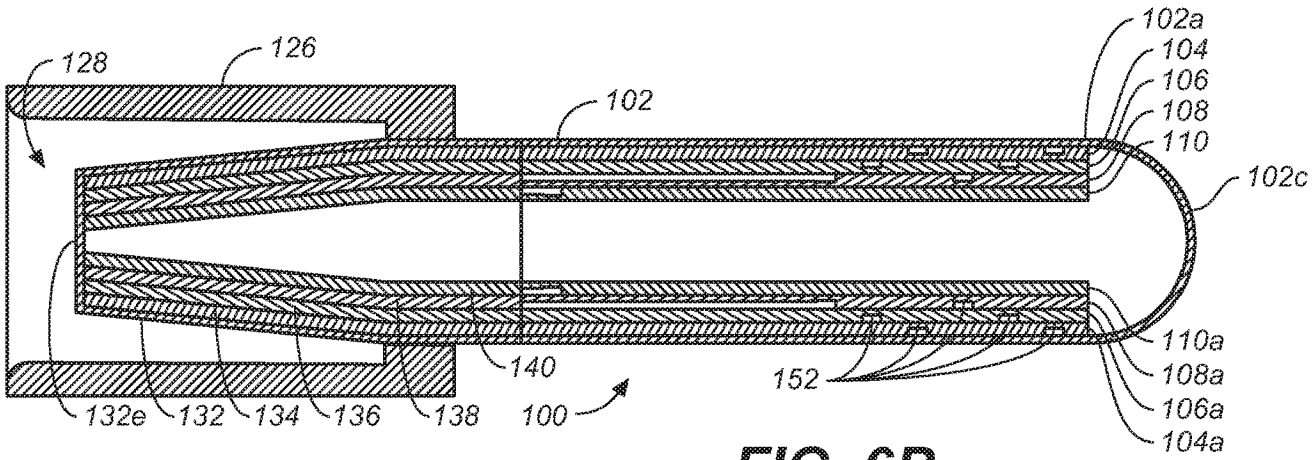
FIG. 6B is a cross-sectional side view in elevation of the male and female connectors coupled, this view showing details of the nested male concentric sleeves and backshell rings.

Referring now to FIG. 3B, an exploded perspective view of only the female connector half 200, it is seen that this element generally echoes the structural and operational components of the male connector half, with dimensional differences immediately evident. Specifically, the female connector half 200 first includes an inboard female receptacle shell 202, and first through third female connector shell rings, innermost to outermost, 204, 206, 208, respectively. In this instance, the connector shell rings are again concentric but are successively larger in diameter, with the next smallest connector shell ring inserting axially into an open end of the immediately larger diameter connector shell ring with tight clearances. The largest female concentric connector ring 208 inserts into a female outer connector shell 210, which covers the nested assembly. The female receptacle shell 202 includes an inboard flange 202*a*, against which all inboard ends 204*a*-210*a* of the concentric connector shell rings and outer connector shell abut when assembled.

Each of the female connector shell rings and outer connector shell includes an inboard end and an outboard end, 204*a*, 206*a*, 208*a*, 210*a*; and 204*b*, 206*b*, 208*b*, and 210*b*, respectively. In assembly the female connector shell rings each insert into the next larger diameter connector shell ring with tight tolerances, such that the outer cylindrical surface of each connector shell ring slidably approximates and engages the inner surface of the next larger connector shell ring. When assembled, the inboard ends of the connector shell rings are in coplanar alignment with one another abutted against the annular flange 202*a* on the innermost connector shell ring 202. The outboard ends align with one another and with the outboard end 102*b* of the female receptacle shell (see FIG. 6A).

The outboard end 202*b* of the female receptacle shell 202 is closed with a cap 202*c* which includes a central female recess 202*d*. The inboard male shell 102 inserts into the receptacle shell such that the end 102*c* engages the cap 202*c*.

A retention plug 212 having a male element connects to the cap 202*c* to provide a mounting structure for female backshells, described below.

The female connector half next includes a plurality of nested female backshells, in order from largest to smallest 232, 234, 236, 238, and being the same in number as the concentric connector rings. Each of the female backshells includes an inboard end and an outboard end, 232*a*, 234*a*, 236*a*, 238*a*; and 232*b*, 234*b*, 236*b*, and 238*b*, respectively; a cylindrical portion 232*c*, 234*c*, 236*c*, and 238*c*; and a conical portion 232*d*, 234*d*, 236*d*, and 238*d*. The outermost female backshell 232 includes a closed end 232*e*, and provides a surface having rows of pin receptacles (apertures) in which conductors are inserted and terminated.

At its outboard end 210*b*, the female outer connector shell 210 couples to and extends inwardly from the inboard end 232*a* of the outermost female backshell 232, which is female wire keep 226.

The outboard end 224 of the female connector half includes an axially oriented female wire keep 226 having an open outer end 228. The wire keep surrounds and installs over a substantial portion of the conical portion 232*d* of the outermost female backshell 232 such that the inboard end 226*a* of the wire keep 226 approximates the line 232*f* where the conical portion 232*d* transitions to the cylindrical portion 232*c* of the backshell 232.

In assembly the conical female backshells each insert into the next larger diameter female backshell with tight tolerances, such that the outer surfaces of the conical portion and cylindrical portion of each female backshell slidably approximates and engages the inner surface of the next larger female backshell. When assembled and in a nested configuration, the inner ends of the female backshells between the receptacle shell 202 and the outer female connector shell 210 are in planar alignment with one another, and the outboard ends of all of the connector shells 202*b*-210*b* also align with one another (again, see FIG. 6A).

As with the male connector half, the female receptacle shell 202 as well as each concentric sleeve between the smallest concentric connector ring 204, 206, 208 and the outer female shell 210 includes several axially oriented parallel rows 250 of pin apertures 252. In the illustrated embodiment, each concentric connector ring includes 6 rows of 12 apertures. In assembly, the rows of the nested concentric sleeves are aligned, such that the aligned apertures create continuous through holes or pin receptacles from the outermost concentric connector shell 208 down to the female receptacle shell 202.

Inserted into the passages (pin receptacles) and extending from the surface 202*c* of the female receptacle shell 202 are rows of conductive pins 254 inserted into the pin apertures in the female receptacle shell 202 and configured to pass through the pin apertures in the female concentric connector rings and to secure the concentric connector rings in their nested configuration, and thereby to provide a conductive path from the cylindrical interior side 202*d* of the female receptacle shell to a conductive filament disposed in a filament channel on one of the interior concentric connector rings.

Each concentric connector ring includes a plurality of filament channels 256 disposed around the surface of the concentric sleeve, each of the filament channels including a transverse portion 256*a* extending from a pin receptacle to a longitudinal portion 256*b*, which extends to the inboard end.

Figure 7:
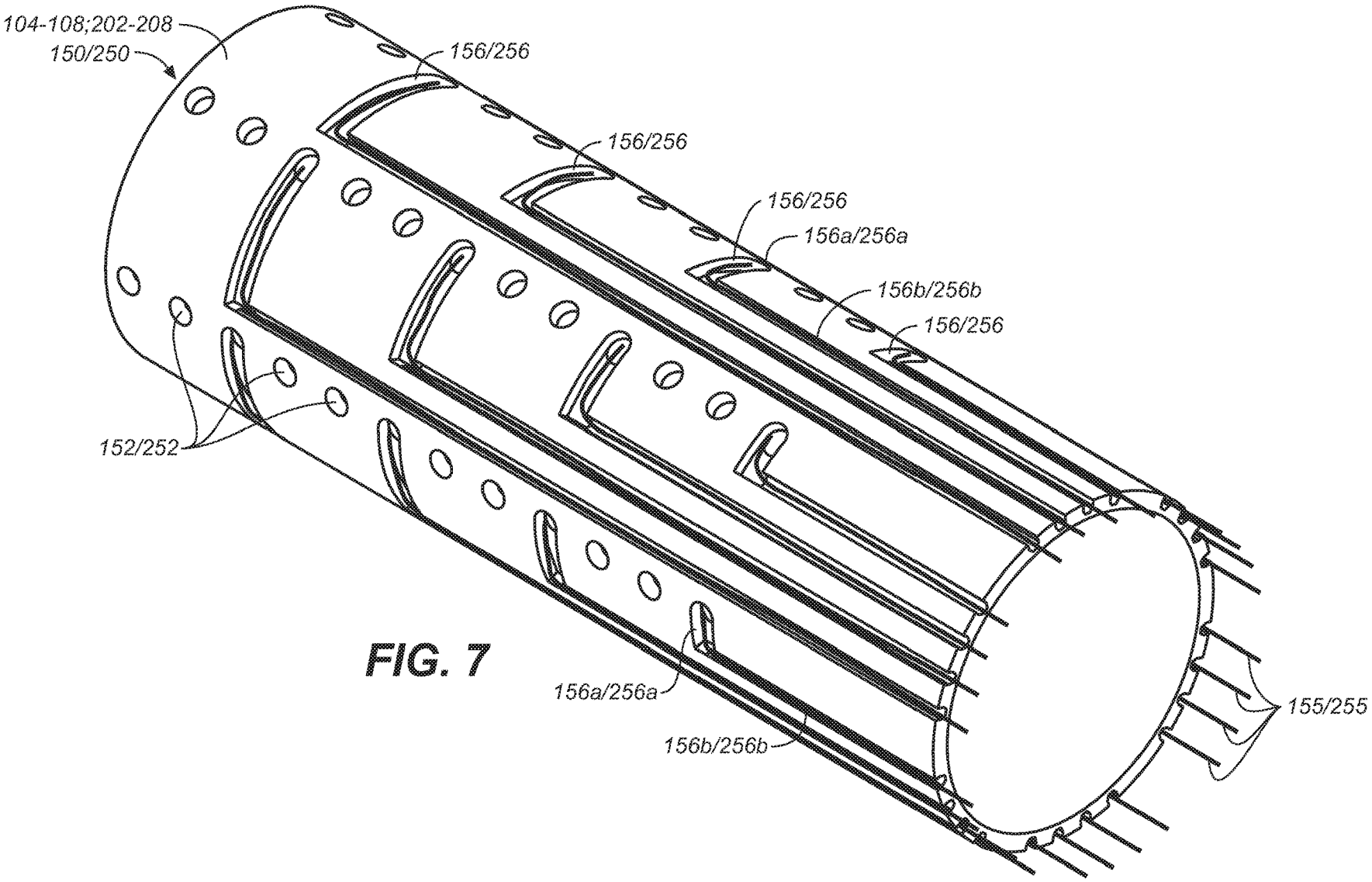
FIG. 7 is a detailed perspective view showing the surface topography of a male or female concentric sleeve.
Figure 8A:
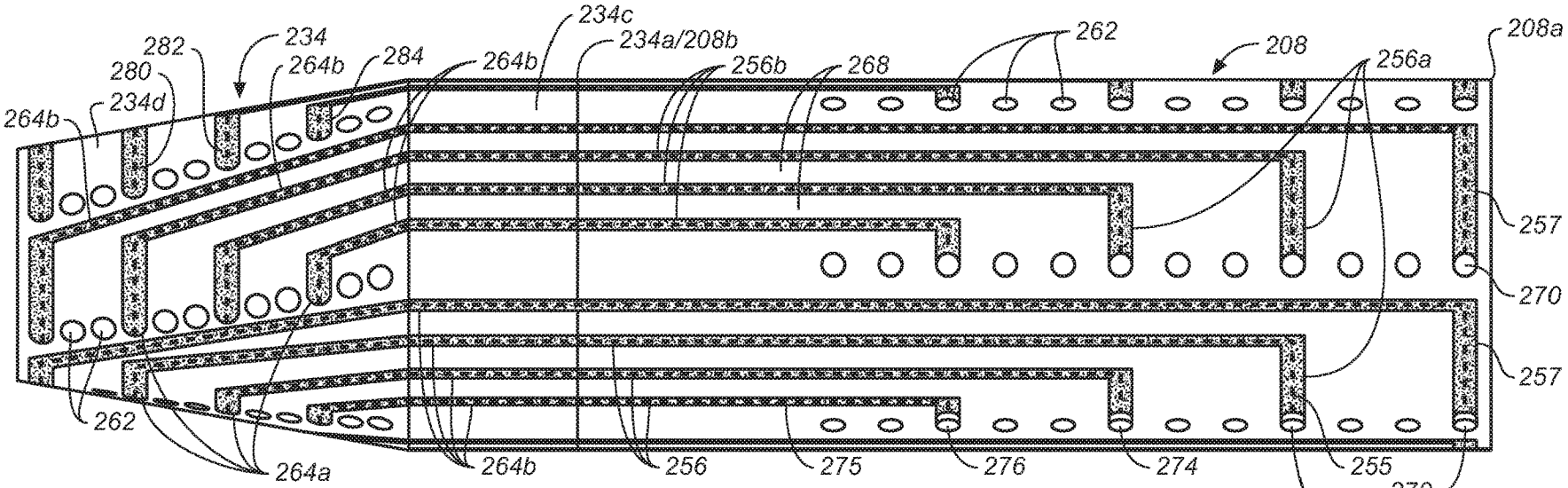
FIG. 8A is a side view in elevation of the outermost female connector sleeve and female backshell ring.
Figure 8B:
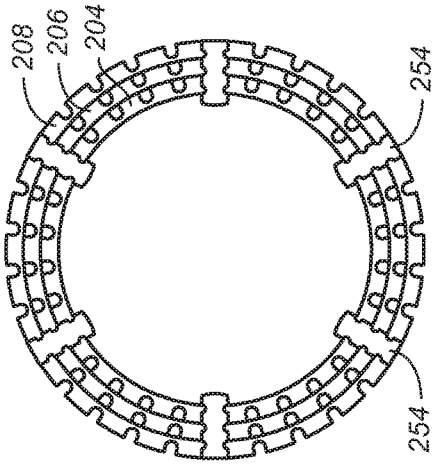
FIG. 8B is an end view in elevation thereof, also showing the two nested inner connector sleeves.
Figure 9A:
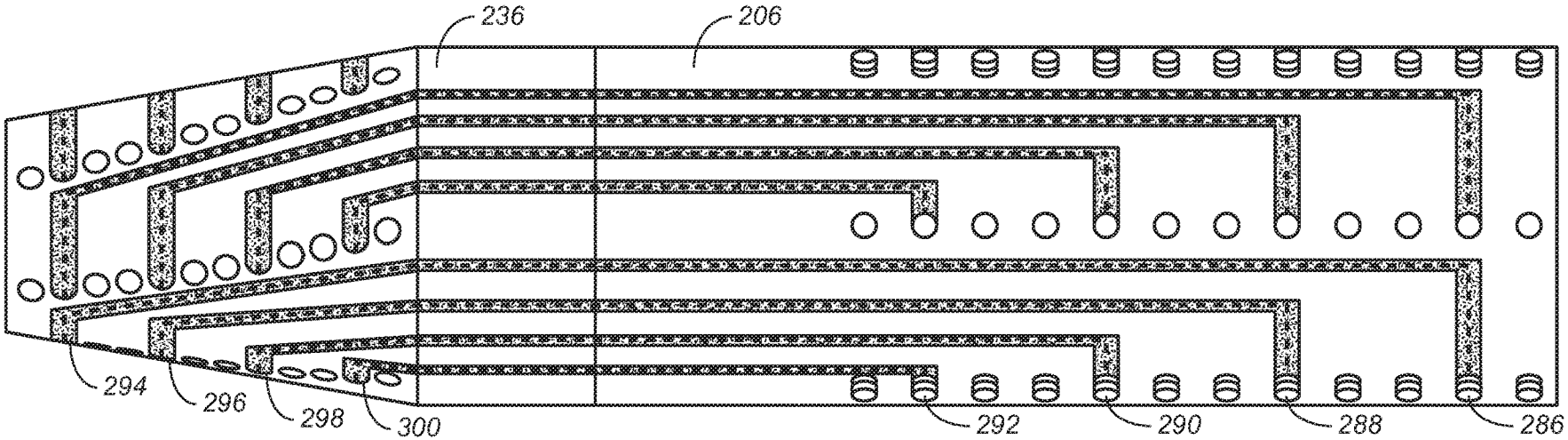
FIG. 9A is a side view in elevation of the middle female connector sleeve and female backshell ring.
Figure 9B:
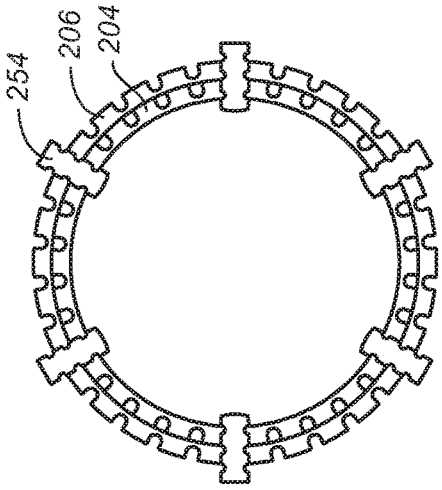
FIG. 9B is an end view in elevation thereof, showing the outermost connector sleeve removed and the nested innermost connector sleeve in place.
Figure 10A:
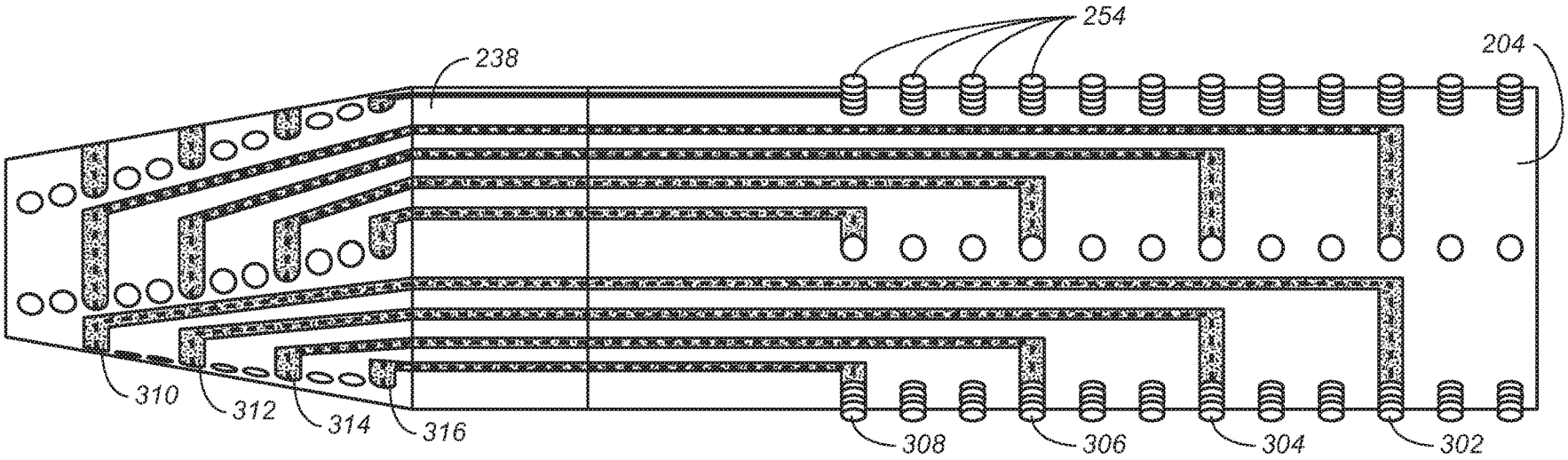
FIG. 10A is a side view in elevation of the innermost female connector sleeve and female backshell ring.
Figure 10B:
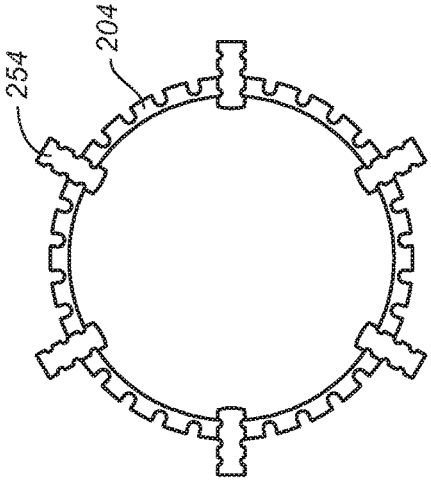
FIG. 10B is an end view in elevation thereof, showing the middle and outermost female connector sleeves removed.

Referring now to FIG. 7, there is shown detail of the filament channels characteristic of both male concentric sleeves and female concentric connector rings. The configuration shown in FIG. 7 is that of female concentric connector ring 204, but this view also shows the structural features of the filament channels more generally, including the structure as found in all of the male concentric sleeves 104-110 and female connector rings 204-208. Here it is seen that each row of pin receptacles 150/250 in the concentric sleeves and concentric connector rings includes a plurality of filament channels 156/256. Each filament channel includes a transverse segment 156*a*/256*a* and a longitudinal segment 156*b*/256*b*, and disposed in each channel is conductive filament 155/255. Not shown in this view is a conductive epoxy disposed in the filament channel to secure the conductive filament and ensure continuity throughout the channel, which is shown in FIGS. 8A, 9A, and 10A.

Similar to the female concentric connector rings, each of the conical portions, 232*d*, 234*d*, 236*d*, and 238*d*, of the nested female backshells, 232, 234, 236, and 238 includes a plurality of spaced apart rows 260 of pin receptacles 262, identical in number with the number of apertures in the female concentric connector rings. The rows on the backshells are angled slightly counterclockwise when viewed on end from the outboard end, which entails looking from the tapered end up the continuous conical side toward the cylindrical portion (see FIG. 5A). Each row terminates at the junction of the conical and cylindrical portions (i.e., where the conical portion abruptly angles and transitions to the cylindrical portion).

Further, all inserted female backshells include filament channels 264 which, precisely as those disposed on the concentric connector rings, include a transverse segment 264*a* and a longitudinal segment 264*b*, the latter angled substantially parallel to the neighboring rows of apertures. The filament channels angle longitudinally along the conical surface to the cylindrical portion where they continue in parallel rows over the cylindrical portion and terminate at the inboard end of the female backshell.

Looking now at FIGS. 8A-10B, there is shown the structure and geometric configurations of the filament channels disposed in the female backshells and female concentric connector rings. Each of the end views (8B, 9B, and 10B) shows layers of concentric sleeves or concentric connector rings, with conductive epoxy and filaments removed from the filament channels so as to show the channels more clearly. As noted previously, the structural and operational features of the female concentric connector rings are essentially identical to those of the male concentric sleeves, and as such, these views provide details of how electrical continuity is achieved over and across the male concentric sleeves coupled to male backshells, as well as the female backshells coupled to the female concentric connector rings.

Looking next at FIG. 8A, and again taking the inboard pin receptacle (that nearest the inboard end 208*a*) as the first and the outboard pin receptacle as the last, female concentric connector ring 208 includes filament channels 256 which include transverse segments 256*a* and longitudinal segments 256*b* extending from the $4^{th}$, $7^{th}$, and $10^{th}$ pin receptacles on each row 272, 274, 276, respectively. The first pin receptacles 270 open to distinct filament channels 257 with a transverse portion only. It will again be noted that the transverse segment is shortened for each successive filament channel, thus separating the longitudinal portions 256*b* of the filament channels with non-conductive sleeve material 268.

Looking next at FIG. 9A, female concentric connector ring 206 also includes four filament channels for each parallel row of pin receptacles, one each extending from the $2^{nd}$, $5^{th}$, $8^{th}$, and $11^{th}$ pin receptacles, 286, 288, 290, 292, respectively. Corresponding to and abutting female concentric connector ring 206, female backshell, 236, includes filament channels in each row of pin receptacles extending from the $2^{nd}$, $5^{th}$, $8^{th}$, and $11^{th}$ female backshell pin receptacles, 294, 296, 298, 300, respectively.

Now referring to FIG. 10A, female concentric connector ring 204 also includes four filament channels for each parallel row of pin receptacles, one each extending from the $3^{rd}$, $6^{th}$, $9^{th}$ and $12^{th}$ pin receptacles, 302, 304, 306, 308, respectively. Corresponding to and abutting female concentric connector ring 204 is female backshell, 238, which includes filament channels in each row of female backshell pin receptacles extending from the $3^{rd}$, $6^{th}$, $9^{th}$, and $12^{th}$, female backshell pin receptacles 310, 312, 314, and 316, respectively.

Thereby, and importantly, while numerical and geometrical patterns bring a highly desired intelligibility and predictable order to the assembly (and thus to its manufacture and use), it will be appreciated that any of a number of alternative geometries are contemplated. The essential feature is the use of opposing conical backshell surfaces on each end of the connector, coupled through multiple layers of concentrically nested sleeves and rings, to provide multiple electrical connections from the opposing ends over continuous electrical paths. The layers needed to accomplish the continuity are determined by the number of pins and pin receptacles on each side of the connector and the available surface area for separating and distributing the filament channels. As a purely practical matter, the number of pin receptacles on the female backshells should match the number on the male backshells, as a difference in number would mean only that there are needless additional apertures on one of the connector backshell assemblies. Likewise, the precise hole sequence for the filament channels need not match on the female and male backshells. However, for ease of use, it makes little sense to do otherwise than to match both the number and the location of the filament channels terminations on each connector half, male and female. The essential aspect, however, is that the number of receptacles employed on each side for a set of filament channels at each layer of the backshells matches precisely, and more essentially, each connector half includes a specific pin on a backshell connected through a filament channel to a specific corresponding pin on the mated other connector half.

The connection of the male concentric sleeves to corresponding male backshells and the connection of the female concentric connector rings to corresponding female backshells, must be rigid. The conductive filaments disposed in the filament channels can alone serve such a function, though when coupled with silver high conductance colloidal epoxy disposed in the channel 175/275 (in the male and female connector halves, respectively), the rigidity is substantially increased. In manufacture, the filament channels on the backshells and the sleeves and rings are filled with epoxy up to a level slightly below flush with the element surface, approximately the upper/outer 0.25-0.38 inches. At that time, the filament is inlaid and then over-epoxied. This is mated to a previously epoxied and assembled backshell (before tack time), or it is assembled one "concentric section" at a time. The entire connector is then cured. In such an embodiment, the backshell cannot be disassembled. In other embodiments, the connector may be designed with a backshell that may be disconnected. This backshell and concentric ring connection is the most challenging portion in manufacture and may be optimized to minimize the number of touches or method steps during manufacture.

Further, the coupling of connector halves must be secure and accurate, with indexing to ensure that the pins on the male shell contact the appropriate pins on the interior side of the female receptacle shell. This may be accomplished through any of a number of indexing and locking assurance means, not shown in the embodiments, but well-known in the art.

Figure 11:
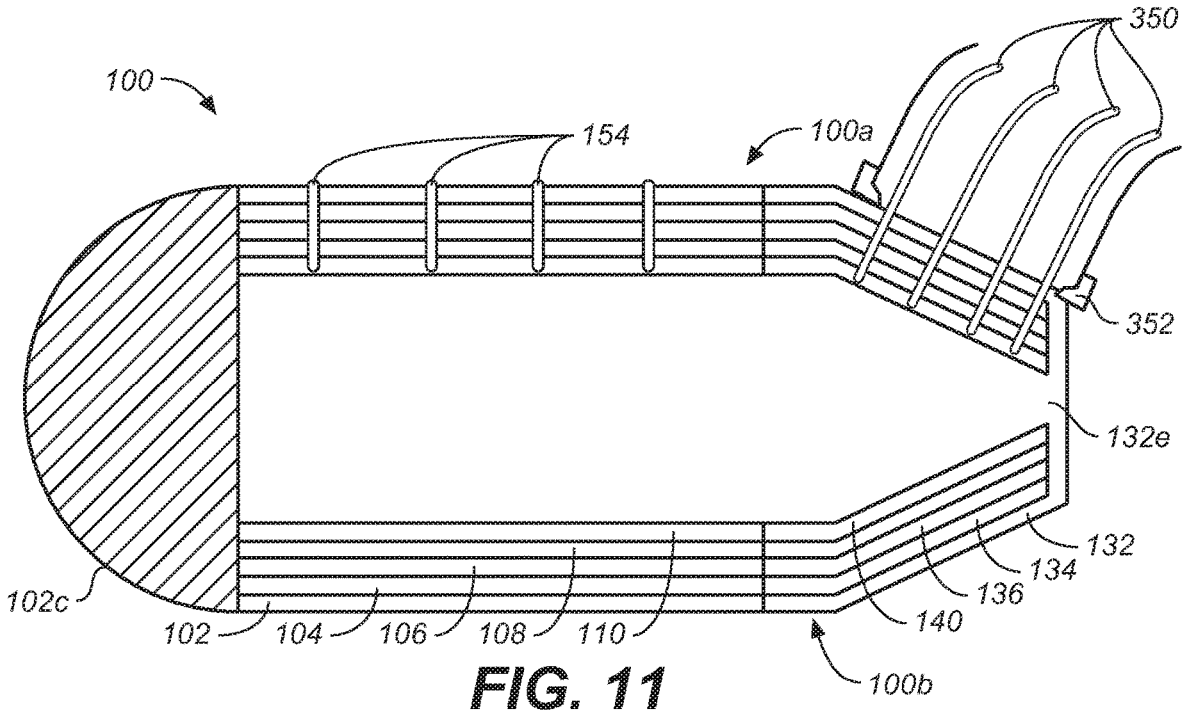
FIG. 11 is a cross-sectional side view in elevation (not proportional to prior views) showing the structure of the helical backshell connection of the backshell concentric rings of the plug element, this view featuring flexible PCBs electrically connected to the helical backshells.

Turning now to FIG. 11, there is shown in a cross-sectional side view in elevation a feed through electrical connection configuration for a male connector half 100 having pin receptacles 162 into which a plurality of flexible PCBs 300 are terminated. The terminations are at receptacles in a multilayer male backshell assembly 100*b* coupled to a corresponding multilayer concentric sleeve assembly 100*a*. When using flexible PCBs rather than traditional wires, the connector assumes a manifold configuration and is used in connection with a locking mechanism or ribbon retention clip 352, and the wire keep is either modified accordingly or is eliminated entirely.

Figure 12:
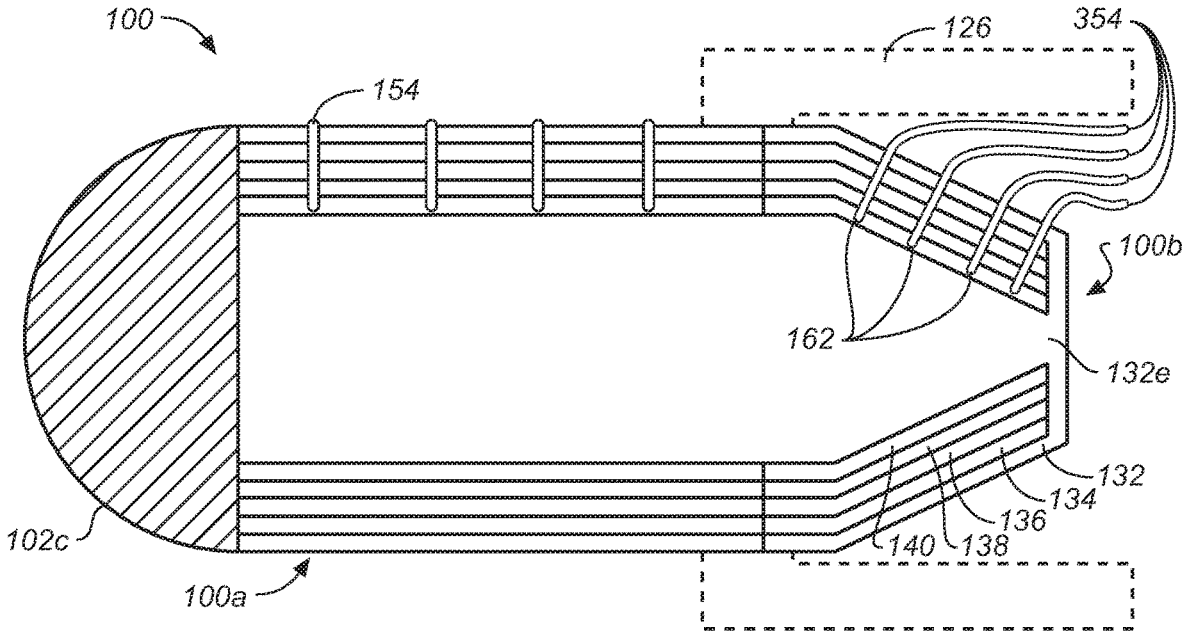
FIG. 12 is a cross-sectional side view in elevation showing a typical feed-through configuration of traditional insulated wires terminated at receptacles in a backshell.

FIG. 12 show the same male connector half configuration 100, here used to terminate traditional insulated wires 354 terminated at pin receptacles 162 in a multilayered backshell. In such an embodiment, use of a wire keep 126 is advantageous and thus preferred.

Figure 13:
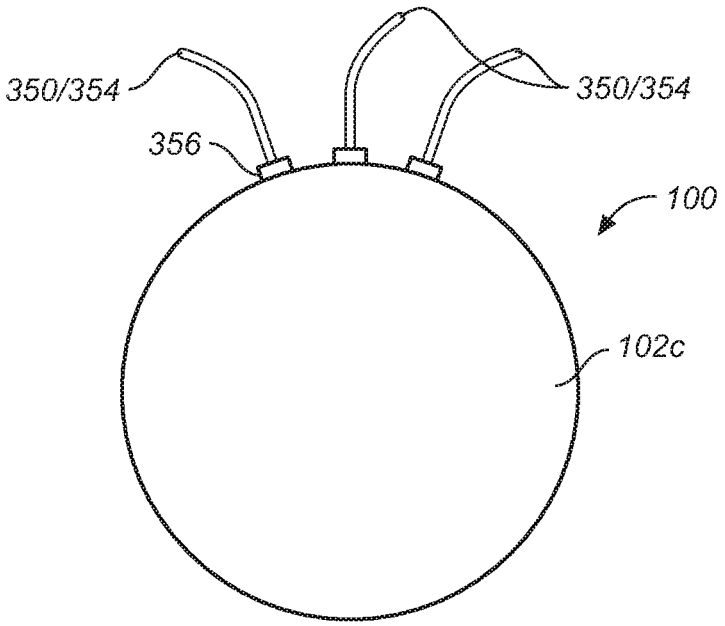
FIG. 13 is an inboard end view in elevation thereof.

FIG. 13 is an end view in elevation of the configurations of both FIG. 11 and FIG. 12, showing flexible PCBs or wires disposed in pin receptacles and secured with an alternative retention mechanism 356.

Figure 14:
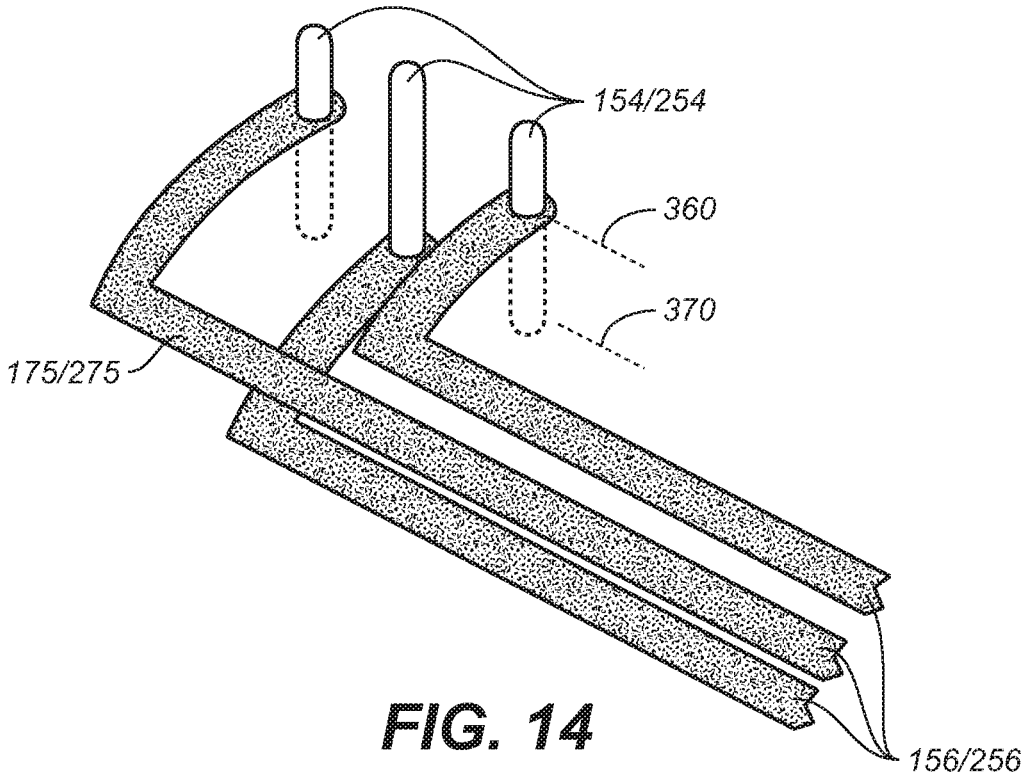
FIG. 14 is a detailed upper perspective view of the contact between pins and the conductive epoxy channels of the connector shells and concentric rings of both the male and female elements.

FIG. 14 is a detailed upper perspective view of the contact between pins and the conductive epoxy channels of the connector shells and concentric rings of both the male and female elements. Here it will be seen that filament channels 256 at a first layer 360 are in electrical contact with the conductive pins 154/254 which secure the male concentric sleeves and female concentric connector shells in their nested configuration and provide a conductive path from the sleeve or connector shell surface to a corresponding pin in the opposing mated other connector half. Conductive epoxy at a second or other layer 370 does not contact the conductor in the first layer. Contact between the pin and the conductive epoxy at those layers where contact is desired is at the depth of the conductive epoxy—i.e., the surface area contact of the epoxy in contact with the pin.

In embodiments, polyethylene is an advantageous insulation material and is a preferred material for fabrication of connector components. The backshells function as insulators, and as such thereby obviate the need for insulated wire.

In embodiments, the conical backshells can include exposed conductive channels, and in other embodiments they can comprise overmolded solid conductors. This latter embodiment imposes manufacturing challenges, making an exposed conductive epoxy and an exposed channel a preferred method, but some applications may use an overmolding construction.

The assembly is designed to be a permanent assembly. However, such a feature is not essential to the inventive foundation. However, manufacture of a serviceable connector capable of disassembly is expensive in manufacture. In embodiments, therefore, the configuration is largely, if not exclusively, dependent upon the configuration of the conical backshell. Once the conical backshell is mated in the assembly process, it need not be changed, but the design can be configured such that it includes such a capability.

When the two connector halves are mated, by inserting the male shell 102 of the male connector half 100 into the female receptacle shell 202 of the female connector half 200, and the proper corresponding pin connections are established through alignment, indexing, and locking, then a plurality of spaced apart continuous electrical paths are created across the connector from each connector half to the other.

From the foregoing, it is seen that in an essential aspect, the electrical connector of the present invention includes: (a) a male connector half including, (i) a plurality of cylindrical concentric sleeves, each of the cylindrical concentric sleeves having a central axis, an inboard end and an outboard end, spaced apart rows of axially aligned pin apertures, the cylindrical concentric sleeves axially aligned and nested in layers so as to bring the pin apertures in the plurality of concentric sleeves into alignment, (ii) a plurality of conductive pins, one inserted into each of the plurality of pin apertures; (iii) a plurality of male backshells having a central axis, a conical portion with an inboard end, and a cylindrical portion having an outboard end, the male backshells axially aligned and nested in layers such that the inboard end of each of the conical portions abuts a corresponding outboard end of one of the cylindrical concentric sleeves, each of the conical portions having a plurality of spaced apart helically curved rows of pin receptacles configured to distribute terminated conductors helically along the central axis, the pin receptacles in all male backshells aligned with one another, and (iv) a cylindrical male shell having a central axis axially disposed over the plurality of concentric sleeves, wherein the male backshells and the cylindrical concentric sleeves are configured with spaced-apart insulated channels containing electrical conductive material bringing one each of the pin receptacles in the male backshells into electrical connection with one of the conductive pins disposed in the pin apertures in the cylindrical concentric sleeves; and (b) a female connector half including, (i) a plurality of cylindrical concentric rings, each of the cylindrical concentric rings having a central axis, an inboard end and an outboard end, spaced apart rows of axially aligned pin apertures, the cylindrical concentric rings axially aligned and nested in layers, the cylindrical concentric rings axially aligned and nested in layers so as to bring the pin apertures in the plurality of concentric rings into alignment, and a plurality of conductive pins, one inserted into each of the plurality of pin apertures, the plurality of female concentric rings including an innermost female receptacle shell configured to receive the male shell in a locking connection so as to bring the pins in the female connector half into electrical contact with the pins in the male connector half, and (ii) a plurality of female backshells having a central axis, a conical portion with an inboard end abutting a corresponding outboard end of one of the cylindrical concentric rings, and a cylindrical portion having an outboard end, the conical portion having a plurality of spaced apart helically curved rows of pin receptacles configured to distribute terminated conductors helically along the central axis, wherein the female backshells and the cylindrical concentric rings are configured with spaced-apart insulated channels containing electrically conductive material bringing one each of the pin receptacles in the female backshells into electrical connection with one of the conductive pins disposed in the pin apertures in the cylindrical concentric rings.

In a more essential aspect, the electrical connector of the present invention is an assembly including a female connector half having a plurality of axially nested female backshells having a conical portion disposed around a central axis, and a plurality of parallel helically curved rows of pin receptacles distributed helically around the central axis, female coupling structure configured to receive an insertion element in a male connector half and having a plurality of conductive pins disposed in the female coupling structure, the female backshells and the female coupling structure including integral electrical pathways between one of each of the pin receptacles and one of the conductive pins in the female coupling structure; and a male connector half having a plurality of axially nested male backshells, including an outer male backshell with a conical portion disposed around a central axis, and a plurality of parallel helically curved rows of pin receptacles distributed helically around the central axis, male coupling structure having a plurality of conductive pins disposed on a surface and configured to insert into the female coupling structure so as to bring the conductive pins in the male coupling structure into electrical contact with the conductive pins in the female coupling structure, the male backshells and the male coupling structure including integral electrical pathways between one of each of the pin receptacles and one of the conductive pins in the male coupling structure; wherein when the male connector half is inserted into the female coupling structure so as to bring the conductive pins of each connector half into electrical contact, each of the pin receptacles in the male backshell has a continuous electrical path to only one of the pin receptacles on the female backshell.

In its most essential aspect, the present invention is seen to include a receptacle and a plug configured for matable connection, the plug and the receptacle each including conical backshells with a surface disposed about a central axis and a plurality of pin receptacles helically disposed in parallel curves around the central axis on the conical backshell surface for terminating conductors.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An electrical pin connector, comprising a receptacle and a plug configured for matable connection, said plug and said receptacle each including a plurality of axially oriented nested conical backshells, male and female, respectively, each of said plurality of male and female backshells including an outer conical backshell having an outer conical backshell surface disposed about a central axis, and a plurality of pin receptacles helically disposed in parallel curves around said central axis on said outer conical backshell surface in which to terminate conductors.

2. The electrical pin connector of claim 1, wherein said pin receptacles are arrayed in helically curved parallel rows.

3. The electrical pin connector of claim 2, wherein said plug includes axially oriented nested cylindrical sleeves, one each connected to one of said plurality of male conical backshells, said cylindrical sleeves having a surface coincident and contiguous with the male backshell to which it is connected, and wherein said receptacle includes axially oriented nested cylindrical connector shell rings, one each connected to one of said plurality of female conical backshells, said cylindrical connector shell rings having a surface coincident and contiguous with the female backshell to which it is connected.

4. The electrical pin connector of claim 3, wherein said cylindrical connector sleeves and said cylindrical connector shell rings each include a plurality of pin apertures, and further including a conductive pin disposed each one of said plurality of pin apertures.

5. The electrical pin connector of claim 4, wherein said pin receptacles are arrayed in evenly spaced apart longitudinally oriented columns.

6. The electrical pin connector of claim 5, wherein each one of said pin receptacles is in electrical contact with one of said conductive pins through a continuous electrically conductive filament channel disposed on contiguous surfaces of one pair of female conical backshells and female cylindrical connector shell rings connected to one pair of male conical backshells and cylindrical sleeves.

7. The electrical pin connector of claim 6, wherein the number of said pin receptacles is equal to the number of said pin apertures.

8. The electrical pin connector of claim 6, wherein said filament channels extend across said continuous and contiguous surfaces of a single layers of connected male conical backshells and male cylindrical sleeves and female conical backshells and cylindrical connected shells.

9. The electrical pin connector of claim 6, wherein said filament channels include a conductive filament.

10. The electrical pin connector of claim 6, wherein said conductive filament is secured in said filament channel with conductive epoxy.

11. A pin electrical connector, comprising:

a female connecter half; and a male connector half;

said female connector half having a plurality of axially nested female backshells having a conical portion with an outer surface disposed around a central axis, and a plurality of parallel helically curved rows of pin receptacles distributed helically around said central axis on said outer surface, said female coupling structure configured to receive an insertion element in said male connector half and having a plurality of conductive pins disposed in said female coupling structure, said female backshells and said female coupling structure including integral electrical pathways between one of each of said pin receptacles and one of said conductive pins in said female coupling structure; and said male connector half having a plurality of axially nested male backshells, including an outer male backshell with a conical portion with an outer surface disposed around a central axis, and a plurality of parallel helically curved rows of pin receptacles distributed helically around said central axis on said outer surface, said male coupling structure having a plurality of conductive pins disposed in said male coupling structure and configured to insert into said female coupling structure so as to bring said conductive pins in said male coupling structure into electrical contact with said conductive pins in said female coupling structure, said male backshells and said male coupling structure including integral electrical pathways between one of each of said pin receptacles and one of said conductive pins in said male coupling structure;

wherein when said male connector half is inserted into said female coupling structure so as to bring said conductive pins of each connector half into electrical contact, each of said pin receptacles in said male backshell has a continuous electrical path to only one of said pin receptacles on said female backshell.

12. A pin electrical connector, comprising:

(a) a male connector half including, (i) a plurality of cylindrical concentric sleeves, each of said cylindrical concentric sleeves having a central axis, an inboard end and an outboard end, spaced apart rows of axially aligned pin apertures, said cylindrical concentric sleeves axially aligned and nested in layers so as to bring said pin apertures in said plurality of concentric sleeves into alignment, (ii) a plurality of conductive pins, one inserted into each of said plurality of pin apertures;

(iii) a plurality of male backshells having a central axis, a conical portion with an inboard end, and a cylindrical portion having an outboard end, said male backshells axially aligned and nested in layers such that said inboard end of each of said conical portions abuts a corresponding outboard end of one of said cylindrical concentric sleeves, each of said conical portions having a plurality of spaced apart helically curved rows of pin receptacles configured to distribute terminated conductors helically along said central axis, said pin receptacles in all male backshells aligned with one another, and (iv) a cylindrical male shell having a central axis axially disposed over said plurality of concentric sleeves, wherein said male backshells and said cylindrical concentric sleeves are configured with spaced-apart insulated channels containing electrical conductive material bringing one each of said pin receptacles in said male backshells into electrical connection with one of said conductive pins disposed in said pin apertures in said cylindrical concentric sleeves; and (b) a female connector half including, (i) a plurality of cylindrical concentric rings, each of said cylindrical concentric rings having a central axis, an inboard end and an outboard end, spaced apart rows of axially aligned pin apertures, said cylindrical concentric rings axially aligned and nested in layers, said cylindrical concentric rings axially aligned and nested in layers so as to bring said pin apertures in said plurality of concentric rings into alignment, and a plurality of conductive pins, one inserted into each of said plurality of pin apertures; said plurality of female concentric rings including an innermost female receptacle shell configured to receive said male shell in a locking connection so as to bring said pins in said female connector half into electrical contact with said pins in said male connector half, and (ii) a plurality of female backshells having a central axis, a conical portion with an inboard end abutting a corresponding outboard end of one of said cylindrical concentric rings, and a cylindrical portion having an outboard end, said conical portion having a plurality of spaced apart helically curved rows of pin receptacles configured to distribute terminated conductors helically along said central axis, wherein said female backshells and said cylindrical concentric rings are configured with spaced-apart insulated channels containing electrically conductive material bringing one each of said pin receptacles in said female backshells into electrical connection with one of said conductive pins disposed in said pin apertures in said cylindrical concentric rings.

* * * * *